US007500525B2

(12) United States Patent
Brink

(10) Patent No.: US 7,500,525 B2
(45) Date of Patent: Mar. 10, 2009

(54) GAS WELL DE-WATERING APPARATUS AND METHOD

(75) Inventor: Donald J. Brink, Broussard, LA (US)

(73) Assignee: Altec, Inc., Broussard, LA (US)

( * ) Notice: Subject to any disclaimer, the term of this patent is extended or adjusted under 35 U.S.C. 154(b) by 62 days.

(21) Appl. No.: 11/649,645

(22) Filed: Jan. 4, 2007

(65) Prior Publication Data

US 2008/0164033 A1 Jul. 10, 2008

(51) Int. Cl.
*E21B 43/00* (2006.01)

(52) U.S. Cl. ..... 166/372; 417/111

(58) Field of Classification Search ..... 166/372; 417/109, 111; 137/155
See application file for complete search history.

(56) References Cited

U.S. PATENT DOCUMENTS

| | | | | | |
|---|---|---|---|---|---|
| 1,547,194 | A | * | 7/1925 | Arbon | 166/106 |
| 2,053,981 | A | * | 9/1936 | Villers | 166/313 |
| 3,897,822 | A | | 8/1975 | Mott | |
| 4,453,599 | A | | 6/1984 | Fredd | |
| 5,257,665 | A | * | 11/1993 | Watkins | 166/372 |
| 5,579,844 | A | | 12/1996 | Rebardi et al. | |
| 5,979,553 | A | | 11/1999 | Brink | |
| 6,089,322 | A | * | 7/2000 | Kelley et al. | 166/370 |
| 6,622,791 | B2 | | 9/2003 | Kelley et al. | |
| 6,923,275 | B2 | | 8/2005 | Gardes | |

OTHER PUBLICATIONS

James Lea, Henry Nickens, Michael Wells, "Gas Well Deliquification—Solution to Gas Well Liquid Loading Problems" Gulf Professional Publishing, 2003, p. 215 to 237.

William C. Lyons, Ph.d., P.E., Gary J. Plisga, B.S., "Standard Handbook of Petroleum & Natural Gas Engineering" 2nd Edition, Gulf Professional Publishing, 2005, pp. 6-149 to 6-165.

* cited by examiner

*Primary Examiner*—Giovanna C Wright
(74) *Attorney, Agent, or Firm*—Gary L. Bush, Esq.; Mark D. Shelley II, Esq.; Andrews Kurth LLP

(57) ABSTRACT

A system and method for systematically and economically recovering formation liquids from the bottom of a petroleum well are disclosed. In a preferred embodiment, the system and method are passive in that they utilize the existing formation pressure of the well to remove fluid build-up across the perforations of the well bore in a manner that is completely free from surface control. The system is comprised of strategically placed carrier subs with installed pressure regulating devices. These carrier subs are regularly spaced below the production packer, along the tail pipe section of the production tubing string and facing the perforated intervals of the well bore. The pressure of the trapped formation gas above the accumulating formation liquid is insufficient to remove all of the formation liquid within the entire length of the tubing string 13. However, an open pressure regulating device mounted on the tailpipe section of the tubing string allows a smaller portion of the formation liquid within the tubing string to be produced to the surface using the existing formation pressure. By systematically removing portions of the formation liquid from within the tubing string using the regularly spaced pressure regulating valves, the formation fluid build-up across the perforations is eliminated, and the petroleum well is able to produce at higher rates and for a longer period without intervention.

20 Claims, 5 Drawing Sheets

GAS WELL DE-WATERING APPARATUS AND METHOD

BACKGROUND OF THE INVENTION

1. Field of the Invention

This invention relates generally to the extraction of petroleum fluids from subsurface formations. More specifically, this invention relates to an apparatus and method for eliminating fluid build-up across the perforations within subsurface wells in order to facilitate greater extraction of petroleum fluids using the natural formation pressure as the primary driving force.

2. Description of the Prior Art

Production costs are a critical consideration in the extraction of the petroleum fluids from subsurface formations. The goal, of course, is to extract petroleum fluid from the subsurface formation at the least expense. The subsurface formation has a naturally occurring pressure that facilitates the removal of petroleum fluids to the surface. Petroleum wells that produce oil and/or gas primarily using the natural formation pressure are generally the least expensive to operate. However, the formation pressure decreases with the life of the subsurface well and thus the rate of petroleum production also declines.

In addition to the temporal decline due to production, formation pressure is adversely affected by the gradual build up of water at the bottom of the well bore. In water bearing formations, water enters the well bore through the same perforations created in the sides of the well bore which permit gaseous petroleum fluids to be extracted horizontally from the formation. As water accumulates at the bottom of the well bore, it begins to rise above and cover the perforations created in the sidewalls of the well bore. The accumulated water exerts its own hydrostatic pressure downward and through the perforation. The pressure of the accumulated water counteracts the natural formation pressure, reducing the effective driving force for producing petroleum fluids to the surface.

At some point, the hydrostatic pressure of the accumulated water overcomes the natural formation pressure such that no gaseous petroleum fluids can be naturally produced. For gas wells, the flowrate of the petroleum gas upwards to the surface must be greater than a critical fluid velocity in order to effectively remove liquids, i.e. water, located between the perforations and the surface. At or below the gas critical velocity, the gas flowrate is insufficient to produce both gas and water from the formation. In this case, the pressure due to the water covering the perforations becomes too great for the formation pressure to maintain the critical velocity of the petroleum gas. Thus, production from the gas well ceases and the well is said to have been killed by the backpressure of the accumulated water.

During the early years of oil and gas production, several basic systems were developed to counteract the effects of accumulated water in the bottom of producing wells. Chief among these systems and methods was the introduction of the tubing string. The tubing string or production casing, which runs almost the entire length of the well bore, fits within the outer bore casing to create an annulus between the two casings. The tubing string terminates towards the bottom of the well bore. One or more packers, usually located close to the lower end terminus of the tubing string, are used to seal the annulus between the outer bore casing and the inner tubing string. Thus, petroleum fluids from the formation are forced upward to the surface through the tubing string rather than through the annular space between the casings. The smaller diameter of the tubing string creates greater fluid velocities for a given formation pressure than could be achieved by the same flow upward through the annulus. This allows water to be unloaded from the production well at lower formation pressures than could have otherwise been achieved.

Tubing strings alone, however, are not adequate to drive production over the long term, because the formation pressure naturally declines over time and with continued production. For many petroleum wells in the United States, for example, the formation pressure is simply too low to effectively produce oil and/or gas. This natural reduction in formation pressure creates the same liquid loading problems within the tubing string as previously discussed; problems that will eventually kill the petroleum well. Therefore, artificial recovery methods, such as gas lift technologies, pumping technologies, etc., have been developed to actively dewater and recover petroleum fluids from subsurface wells. In artificial gas lift technologies, an injection gas is typically introduced from the surface through the annulus and into the tubing string through a one-way operating valve. The packer prevents the injection gas from flowing to the bottom of the well bore through the annulus. This prevents the injection gas from creating any additional backpressure on the formation through the perforations below the packer. As is well known in the art, the one-way operating valve is disposed at an optimum depth within the tubing string to adequately mix the injected gas with the accumulated fluids. The injection gas reduces the density of the accumulated fluids thereby allowing any remaining formation pressure to produce the accumulated fluids to the surface. Thus, the petroleum well is unloaded above the one-way operating valve using injected gas to "lift" the accumulated fluids from within the tubing string.

If the accumulated fluid rises in the tubing string to a level above the operating valve, then an increasingly high pressure may be required in order to counteract the backpressure of the fluid accumulating above the operating valve. Furthermore, the pressure required may not be readily available using equipment on the surface. To mitigate this problem, additional "unloading" valves are disposed within the tubing string at locations above the operating valve. These pressure-actuated, one-way valves are systematically opened and shut to "unload" the accumulated fluid. Starting from a position just below the level of accumulated fluid within the tubing string, an "unloading" valve is opened, while the other valves remain shut. This allows the injection gas to "lift" the volume of accumulated fluid above the opened valve in the tubing string. After this volume of accumulated fluid is removed, the valve is shut and the next lowest valve is opened. Thus, the tubing string is systematically "unloaded" by progressively opening and shutting "unloading" valves down the tubing string.

The depletion of easily accessible, near-surface petroleum reserves has resulted in petroleum wells of ever increasing depth. Gas wells, in particular, are currently constructed with long intervals requiring several tube string zones. Production problems encountered at these depths are the result of long intervals, low gas permeability, low bottom hole pressure, and the mixture of gas and water in the tubing string. For example, long intervals require a packer with a tail pipe. The tail pipe is essentially a continuation of the tubing string that extends below the packer. The tail pipe, like the tubing string, has a smaller diameter than the surrounding outer casing, therefore higher fluid velocities can be maintained in the tail pipe for the same volume of fluid. As previously described, low formation pressure effectuates a fluid velocity in the larger diameter outer casing below the packer that is insufficient to produce the liquid which accumulates at the bottom of the well bore. Any liquid carried upward toward the surface by the rising gas simply falls back and accumulates at the bottom of the well hole. The accumulated fluid increases the backpressure on the formation which subsequently reduces the gas production and in many cases eventually kills the well.

A similar situation develops if the tail pipe does not extend far enough below the packer. Without sufficient tail pipe length, the upward velocity of the fluid entering the well bore from the formation will be reduced due to the large diameter outer casing encountered at the bottom of the well bore below the packer. This reduction in velocity will be inadequate to remove liquids which accumulate at the bottom of the well bore. Any liquid carried upward toward the surface by the rising gas simply falls back and accumulates at the bottom of the well hole. The accumulating fluid increases backpressure on the formation which subsequently reduces the gas production and in many cases eventually kills the well.

The prior art continues to address the problem of liquid loading in petroleum wells by developing new and/or improved artificial methods, such as the previously disclosed gas lift technologies, which essentially replace any driving force that may be imparted by the natural formation pressure. Much of the artificial gas well liquid unloading technology, however, is energy intensive. This severely curtails the profitability of gas well production when energy costs are significant. For liquid loaded subsurface wells, the added expense of artificial recovery equipment and processes reduces the overall profitability of petroleum production and in some cases causes the wells to be marginally profitable or even unprofitable. Therefore, a more cost effective strategy for unloading petroleum wells that preferably relies on the natural formation pressure is desirable. However, with the advent of these artificial gas lift technologies, much less focus has been placed in recent years on developing systems and methods which dewater a loaded gas well using the natural formation pressure as a primary driving force.

The foregoing illustrates a few of the shortcomings of the prior art. Liquid loading at the bottom of the well bore obstructs and/or impedes the natural flow of gas through the well bore perforations. This can be especially detrimental for petroleum wells having large perforation intervals. Therefore, an economical system that systematically unloads formation liquid obstructing well bore perforations throughout the depth of well bore is highly desirable.

IDENTIFICATION OF OBJECTS OF THE INVENTION

A primary object of the invention is to provide a method and system for systematically and economically removing formation liquids, which obstruct and/or impede the natural flow of formation gas through sidewall well bore perforations disposed below the packer and extending toward the bottom of the well bore.

Another object is to provide a method and system for systematically and economically removing formation liquids, which obstruct and/or impede the natural flow of formation gas through sidewall well bore perforations disposed below the packer, where the pressure of the formation is the primary driving force for formation liquid removal.

Another object is to provide a method and system for systematically and economically removing formation liquids, which obstruct and/or impede the natural flow of formation gas through sidewall well bore perforations in gas wells with large perforation intervals below the packer.

Another object is to provide a method and system which increases formation gas production from a gas well by systematically and economically removing formation liquids, which obstruct and/or impede the natural flow of formation gas through sidewall well bore perforations disposed below the packer.

Other objects, features, and advantages of the invention will be apparent to one skilled in the art from the following specification and drawings.

SUMMARY OF THE INVENTION

The objects identified above, along with other features and advantages of the invention are incorporated in a system and method for petroleum wells aimed at eliminating formation liquid build-up across the perforations of the well. In a preferred embodiment, the system and method are passive in that they utilize the energy of the well, itself, (i.e., the formation pressure) to remove fluid build-up in a manner that is completely free from surface control. The system is comprised of strategically placed carrier subs (i.e. conventional or side pocket mandrels) with installed pressure regulating devices. These carrier subs are regularly spaced below the production packer, along the tail pipe portion of the production tubing string and facing the perforated intervals of the well bore.

During production of the well, formation liquids accumulate at the bottom of the well bore. The level of accumulating liquids begins to rise when the formation pressure becomes inadequate to produce these liquids to the surface. The accumulating liquids eventually rise above the lower end of the tubing string, effectively trapping formation gas in the annular space beneath the packer and between the production casing and the tubing string. Gas from the formation continues to rise through the accumulating liquids and into this annular space. The formation gas accumulating in the annulus exerts a downward pressure on the rising formation liquids. However, the pressure is not adequate to produce to the surface both the accumulated fluid beneath the trapped gas and within the tubing string. Nonetheless, the pressure of the trapped gas becomes sufficient in time to move the column of accumulating liquid downward toward the pressure regulator contained inside of the carrier sub disposed within the tail pipe. The carrier sub allows direct communication between the trapped gas and the internal pressure regulator. As the gas passes into the pressure regulator, the regulator senses the pressure differential between the outside and inside of the tubing string. If the pressure differential is greater than a preset value then the regulator directs the gas into the production tubing string thereby lowering the density of production fluids inside of the tubing string, decreasing the tubing pressure, and producing to the surface the fluids within the tubing string above the carrier sub. This initiates the systematic process of removing liquid build-up beneath the packer and across the perforated zones of the well.

Depending upon the length of the perforated zones, additional carrier subs with internal pressure regulators are spaced out along the tubing string allowing deeper points of gas injection, and consequently, more fluid build-up below the packer to be produced from the well bore. The deeper gas injection points also create lower "flowing bottom-hole" pressures from the reservoir, which allows the well to be produced at higher rates using the existing formation pressure. As a result, the well is able to produce formation fluids for a longer period of time and without surface intervention.

BRIEF DESCRIPTION OF THE DRAWINGS

By way of illustration and not limitation, the invention is described in detail hereinafter on the basis of the embodiments represented in the accompanying figures, in which.

DESCRIPTION OF THE PREFERRED EMBODIMENTS OF THE INVENTION

Figure 1:
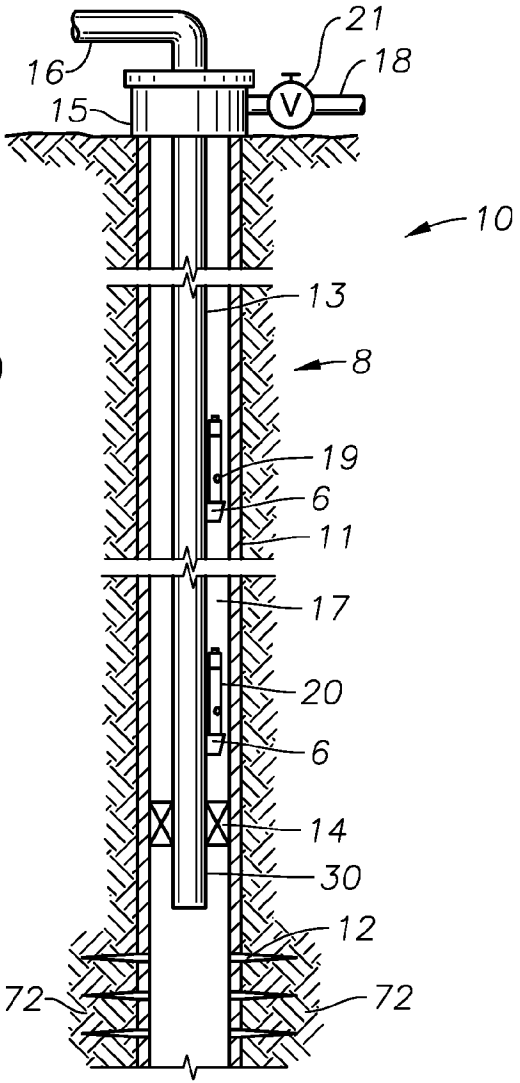
Fig. 1 (Prior Art)
FIG. 1 is a schematic illustration of a prior art gas-lift well arrangement 10 with a well casing 11 lining a well bore 8 and showing installed or "landed" within the casing 11 a fluid production string 13 having at least one differential pressure responsive valve 19, 20 therein.

The preferred embodiment of the invention alleviates one or more of the deficiencies described in the prior art and incorporates one or more of the objects previously identified. Referring now to the drawings, FIG. 1 illustrates a prior art well arrangement 10 employing artificial gas-lift technologies. A well bore 8 is lined with well casing 11 that, during well completion is perforated at 12 so that oil, gas, and other formation fluids from a subsurface earth production zone 72 can enter through casing 11. Production tubing string 13 extends from the surface down to packer 14, which is set above perforations 12 so that the oil, gas, and other formation fluids must flow up tubing string 13 to the surface 74, through casing head 15 and into production line 16.

A series of spaced pressure regulating valves 19, 20 are mounted on the tubing string 13 above packer 14 using conventional mandrels 6, with the lowermost pressure regulating valve 20 being arranged to control the injection of fluid from annulus 17 into tubing string 13. The gas-lift technology consists of a suitable compressor (not shown) at the surface which supplies gas pressure though line 18 and valve 21 to annulus 17 between casing 11 and tubing string 13. The upper differential pressure regulating valves 19 typically are used only for initially "unloading" liquids, such as formation fluids and/or completion fluids, in annulus 17 down to the bottom differential pressure regulating valve 20. During this unloading operation, a portion of the formation fluid in the tubing string 13 may also be unloaded. For continued production of the well, the bottom differential pressure regulating valve 20 is used to aerate the formation fluid column in tubing string 13 with gas so that the natural pressure of the formation fluid in the production zone 72 is sufficient to lift the reduced density formation fluid to the surface 74. Once differential pressure is initiated at the lowermost valve 20, the upper valves 19 remain closed. Thus, the upper 19 and lower 20 valves operate together to initially "unload" accumulated formation fluids from the tubing string 13 and to prevent the hydrostatic pressure in the tubing string 13 from rising to a level where the accumulating formation fluid cannot be produced to the surface 74.

Below the packer is the tailpipe 30 section of the tubing string 13. As shown in FIG. 1, the tailpipe 30 section of most prior art drilling arrangements 10 is relatively short or even nonexistent. As previously disclosed, however, gas wells with long perforation intervals require a tailpipe section 30 below the packer 14 in order to create sufficient fluid velocity to remove formation fluids from the bottom 70 of the well bore 8. Without sufficient tail pipe length, the upward velocity of the fluid entering the well bore 8 from the formation 72 will be reduced due to the large diameter outer casing 11 encountered at the bottom 70 of the well bore 8 below the packer 14. This reduction in velocity will be inadequate to remove liquids which accumulate at the bottom 70 of the well bore 8. Any liquid carried upward toward the surface 74 by the rising gas simply falls back and accumulates at the bottom 70 of the well hole 8. The rising liquid at the bottom 70 of the well bore 8 increases backpressure on the formation 72 which subsequently reduces the gas production and in many cases eventually kills the well.

Figure 2:
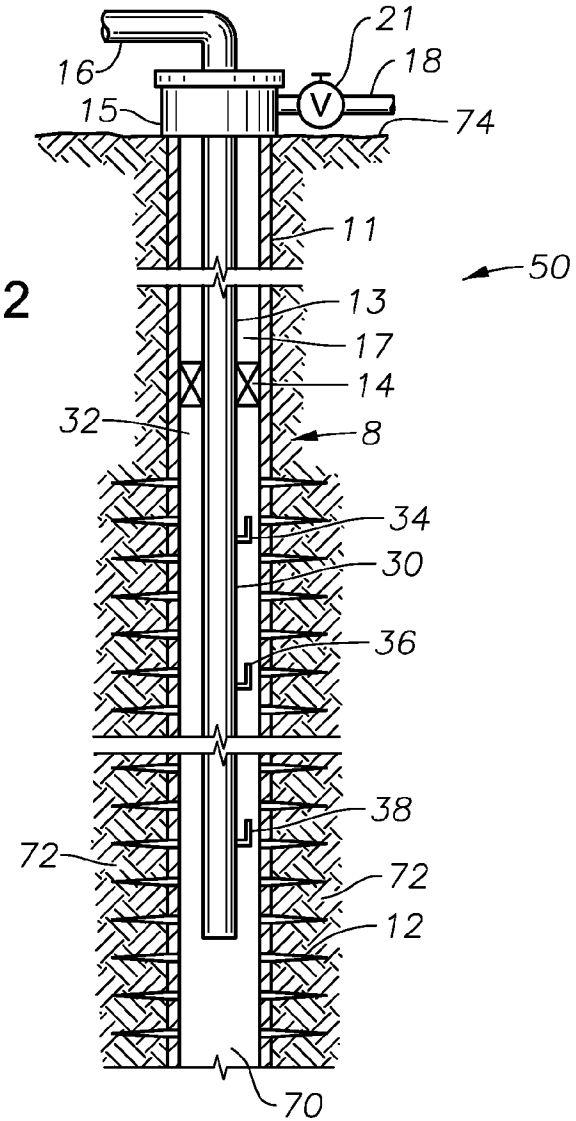
FIG. 2 illustrates a preferred embodiment 50 of the invention in which a series of optimally spaced pressure regulating valves 34, 36, 38 are mounted on the tailpipe section 30 of the production tubing 13 and are used in succession to systematically "unload" any formation fluids trapped in the annulus 32 below the packer 14.

While similar to the prior art well arrangement 10 of FIG. 1, a preferred embodiment 50 of the invention, as shown in FIG. 2, has a much longer and more functional tailpipe section 30. In a preferred embodiment 50 of the invention, the tailpipe section 30 of the production string 13 extends downward below casing perforations 12 and considerably below packer 14. The tailpipe 30 has a series of pressure regulating valves 34, 36, 38 optimally spaced and mounted along the entire length of the tailpipe section 30 extending toward the bottom 70 of the well bore 8. Each of the pressure regulating valves 34, 36, 38 is preferably housed within or supported by carrier subs (not shown) optimally spaced and disposed within the tailpipe section 30. In addition, the pressure regulating valves 34, 36, 38 are preferably of the construction and function as set forth in U.S. Pat. No. 5,522,418 issued to Johnson, et al., although other differential pressure responsive valves may also be effectively employed. The pressure regulating valves 34, 36, 38 disposed below the packer 14 are used in succession to systematically "unload" any formation fluids and/or completion fluids in the annulus 32 downward toward the lower end of the tailpipe 30. During the unloading operation, formation gases accumulate in the annular space 32 below the packer 14, effectively becoming trapped. As these formation gases accumulate, their pressure increases thereby exerting a downward pressure on the formation liquids rising in the annular space 32 above the lower end of tailpipe section 30. The trapped formation gases force the formation liquids downward toward a next pressure regulating valve 36 mounted on the tailpipe section 30 below the packer 14.

The pressure regulating valves 34, 36, 38 mounted on the tailpipe section 30 of the tubing string 13 permit fluid communication between the inside of the tailpipe 30 and the annulus 32 at optimized intervals along the tailpipe 30. Each pressure regulating valve 34, 36, 38 effectively lowers the head required to produce to the surface 74 the formation liquid within the tailpipe 30 above the particular pressure regulating valve 34, 36, 38. In other words, the trapped formation gas in the annular space 32 below the packer 14 must only have a pressure greater than the head associated with the formation liquid within the tailpipe 30 above the particular pressure regulating valve 34, 36, 38 in order to produce this liquid to the surface 74. In a tailpipe 30 without pressure regulating valves 34, 36, 38, however, fluid communication between the trapped annular gas and the inside of the tailpipe 30 occurs only at the opening at the lower end of the tailpipe 30. Thus, the pressure of the trapped gas within the annular space 32 (which can have a pressure no greater than the formation pressure) must overcome the head associated with the formation liquid rising throughout the entire length of the tubing string 13 in order to produce this liquid to the surface 74. Therefore, the pressure regulating valves 34, 36, 38 effectively lower the head of the formation liquid within the tailpipe section 30 such that this liquid as can be produced to the surface 74 using the existing formation pressure.

Figure 3B:
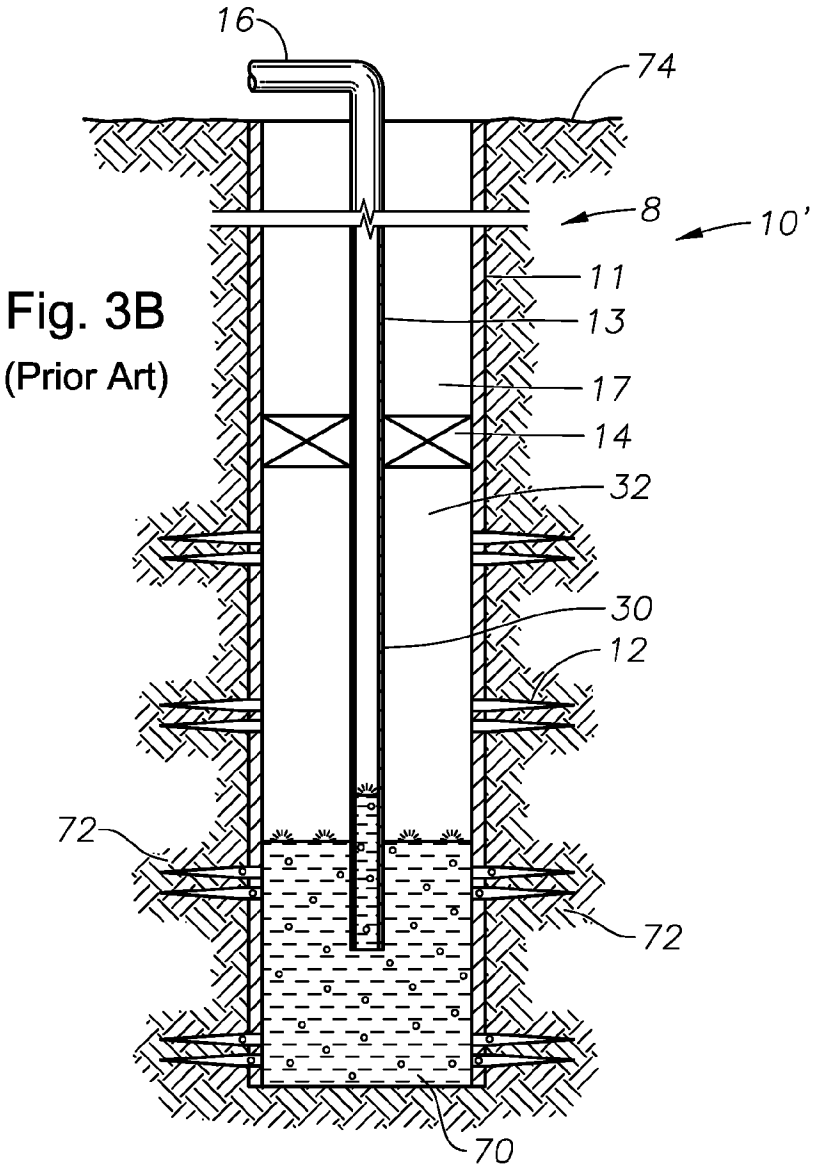
Fig. 3B (Prior Art)
FIGS. 3A, 3B, and 3C illustrate the action of the accumulating formation fluid in a conventional well arrangement 10' without pressure regulating valves 34, 36, 38 mounted on the tailpipe section 30 of the tubing string 13 below the packer 14.
Figure 3A:
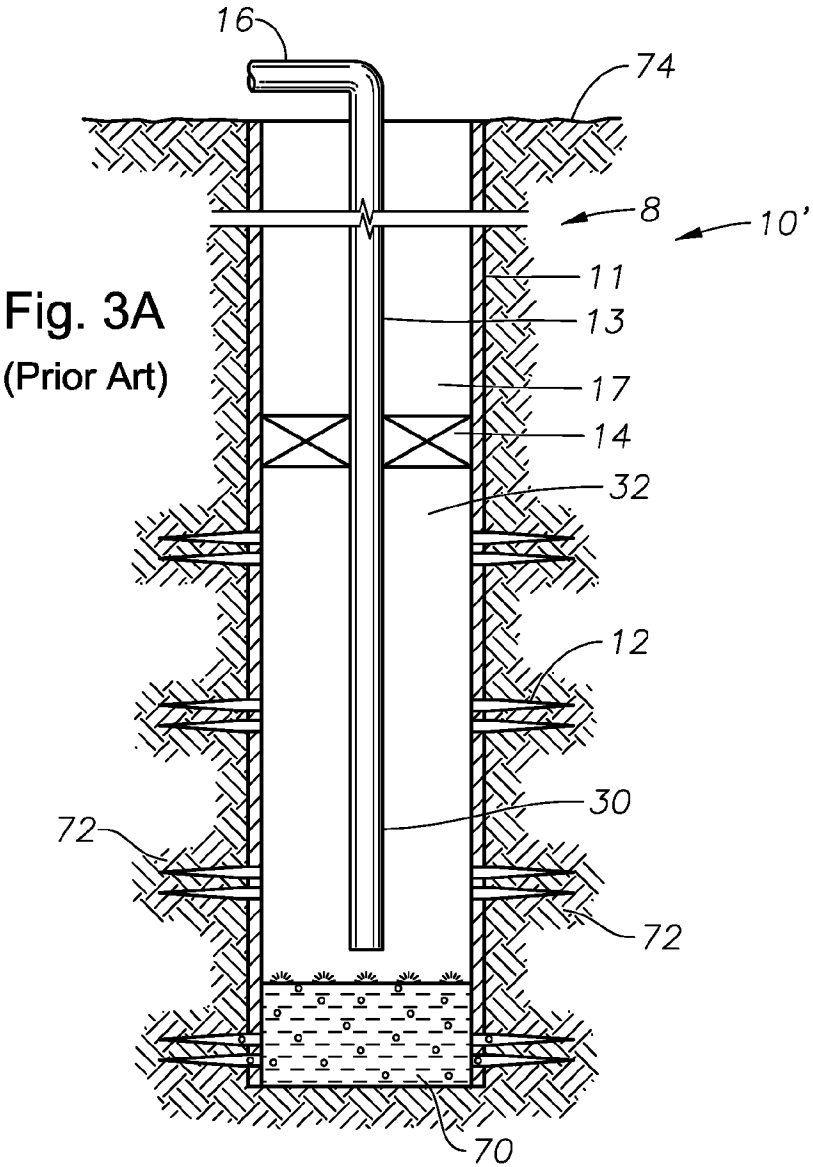
Fig. 3A (Prior Art)
Figure 3C:
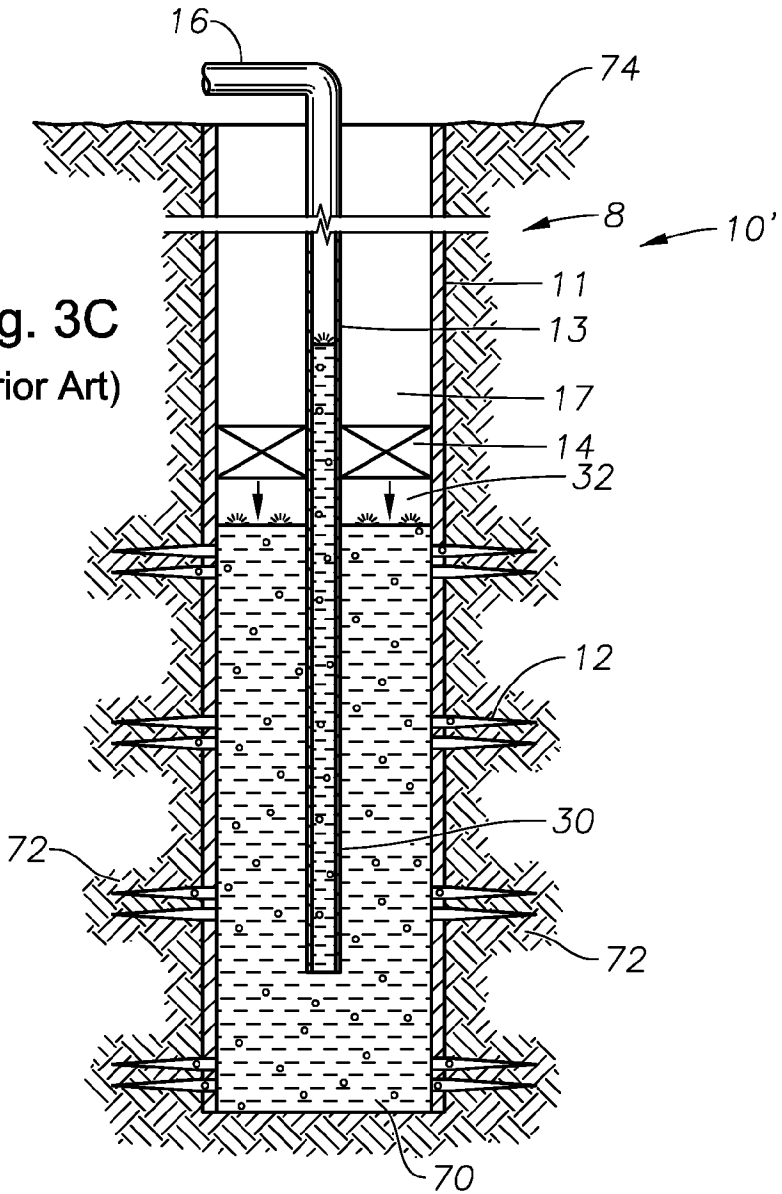
Fig. 3C (Prior Art)

FIGS. 3A, 3B, and 3C illustrate a conventional well arrangement 10' without pressure regulating valves 34, 36, 38 (FIG. 2) mounted on the tailpipe section 30 of the tubing string 13. As shown in FIG. 3A, formation liquids accumulate at the bottom 70 of the well bore 8 during well production. The formation pressure naturally declines as the well is produced and may become inadequate to produce these accumulating formation liquids to the surface 74. At such time, the level of accumulating liquids begins to rise. As shown in FIG. 3B, the accumulating formation liquids eventually rise above the lower end of the tailpipe 30 section of tubing string 13, effectively trapping formation gas in the annular space 32 beneath the packer 14 and between the production casing 11 and the tubing string 13. Gas from the formation 72 continues to rise through the accumulating liquids and into this annular space 32. As shown in FIG. 3C, the evolved formation gas accumulating in the annulus 32 exerts a downward pressure (as illustrated by the downward arrows) on the rising formation liquids. However, the pressure is not adequate to produce to the surface 74 both the accumulated fluid beneath the trapped gas and within the tubing string 13.

Figure 4A:
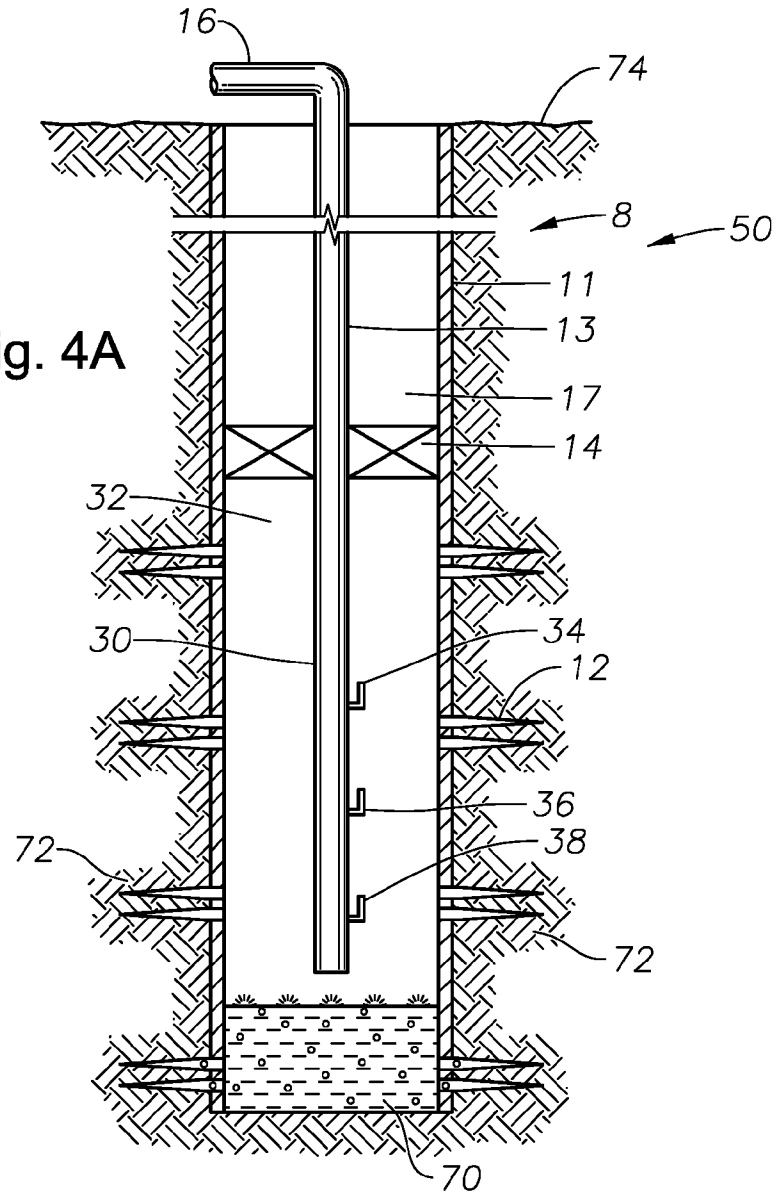
FIGS. 4A, 4B, 4C, and 4D illustrate the method of a preferred embodiment 50 of the invention in which pressure regulating valves 34, 36, 38 disposed below the packer 14 are used in succession to systematically "unload" formation fluids in the annulus 32 downward toward the lower end of the tailpipe 30.
Figure 4C:
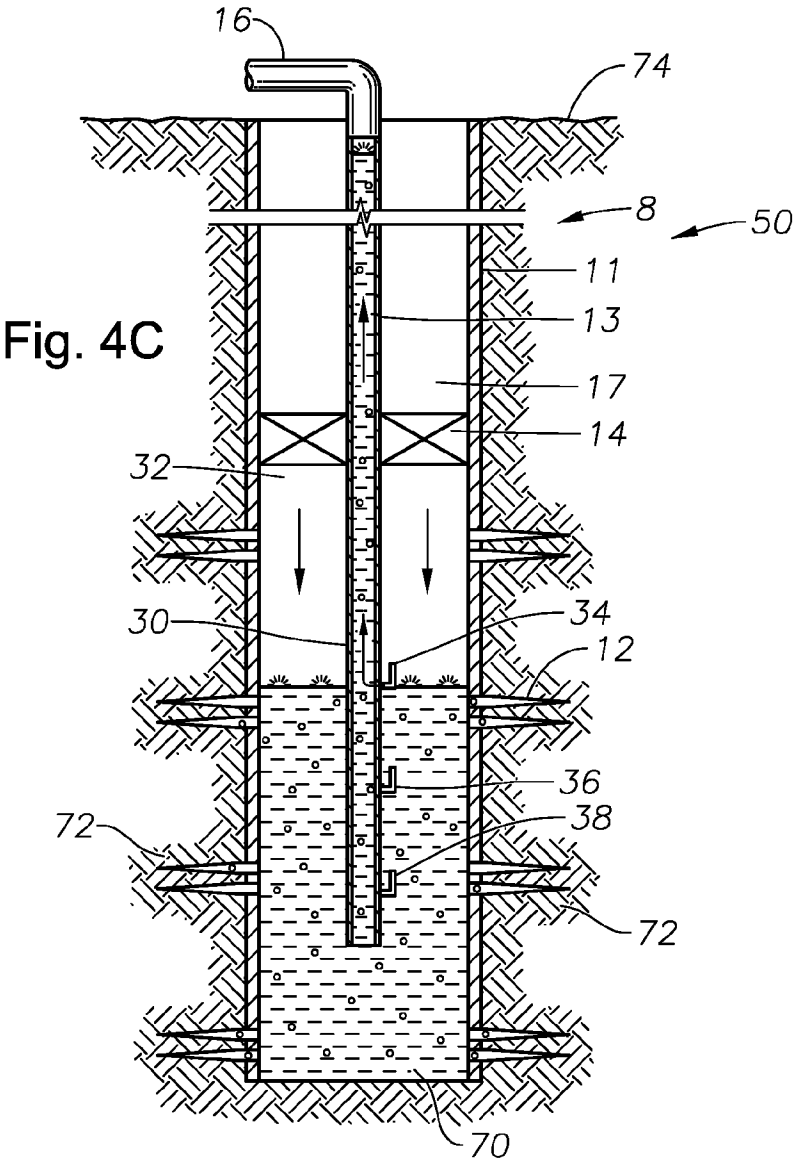
Figure 4B:
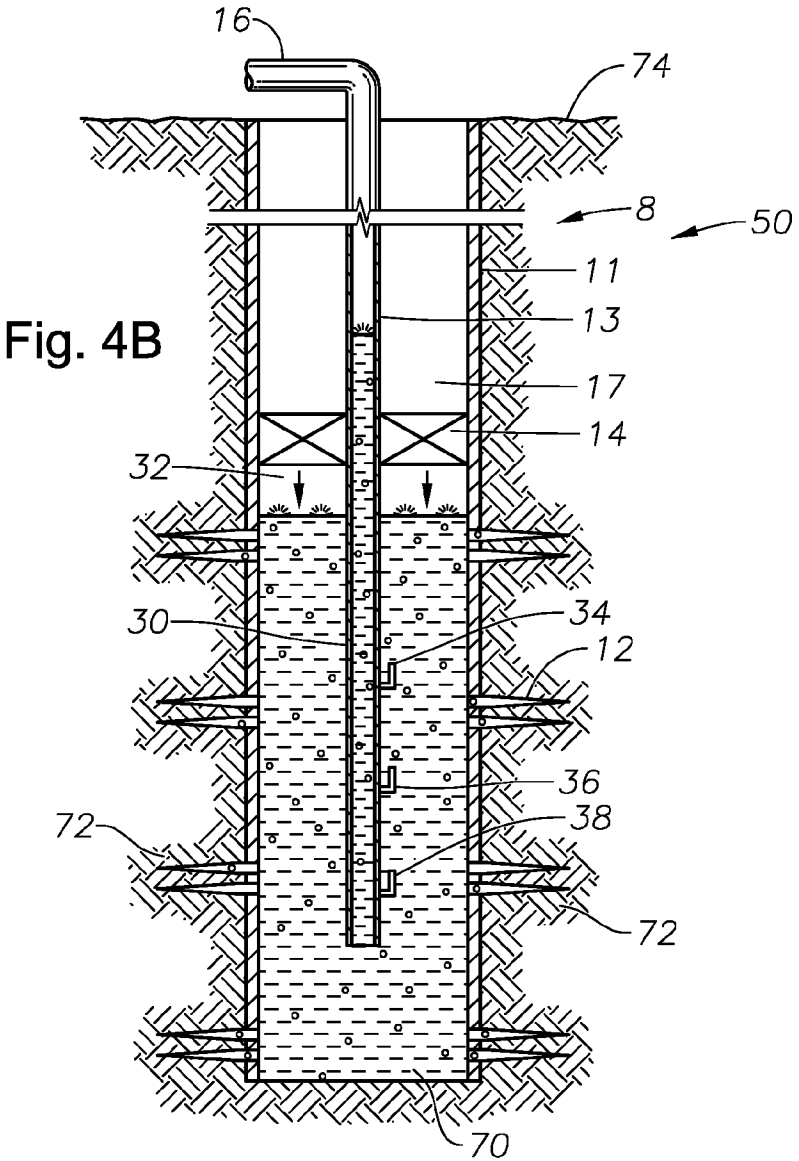

FIGS. 4A, 4B, 4C, and 4D illustrate a preferred embodiment 50 of the invention in which pressure regulating valves 34, 36, 38 are optimally spaced and mounted along the tailpipe section 30 of the tubing string 13. The pressure regulatory valves 34, 36, 38 are preferably housed within or supported by carrier subs (not shown) disposed within the tailpipe section 30. As shown in FIG. 4A, if the formation pressure is insufficient, formation liquids accumulate at the bottom 70 of the well bore 8 rather than being produced to the surface 74 through the tubing string 13 along with the formation gases. If the pressure regulating valves 34, 36, 38 are kept closed, then the formation liquids will rise to a level above the lower end of the tailpipe section 30 of the tubing string 13, as shown in FIG. 4B, eventually reaching an equilibrium position above the upper most pressure regulating valve 34. The equilibrium position occurs when the pressure of the accumulated gas in the annulus 32 beneath the packer 14 equals the formation pressure. Gas from the formation will continue to slowly evolve and accumulate within the annular space 32 below the packer 14, thereby increasing the pressure of the trapped annular gas. This trapped formation gas need only have a pressure greater than the head associated with the tailpipe formation liquid disposed above an open pressure regulating valve 34, 36, 38 in order to produce this liquid to the surface 74.

If the well bore is "loaded" with formation liquid, as shown in FIG. 4B, the upper most pressure regulating valve 34 is used to "unload" the well. In time, the pressure of the trapped gas (as illustrated by the downward arrows) becomes sufficient to move the annular column of formation liquid downward toward and below the first pressure regulating valve 34 housed within or supported by a carrier sub (not shown). The carrier sub (not shown) allows direct communication between the trapped gas within the annulus 32 and the internal pressure regulator 34 housed within or supported by the carrier sub (not shown). As the gas, which drives the downward movement of formation liquid, passes into the pressure regulator 34 through open perforations within the carrier sub (not shown), the regulator 34 senses the pressure differential between the outside and inside of the tailpipe section 30 of tubing string 13. If the pressure differential is greater than a preset value, then the regulator 34 directs the gas from annulus 32 into the inside of tailpipe 30. As shown in FIG. 4C, the trapped gas passes into the tailpipe section 30 of the tubing string 13 through the first opened pressure regulating valve 34. As trapped annular gas passes into the tubing string 13 through the opened pressure regulating valve 34, the gas mixes with the formation liquid above the pressure regulating valve 34 thereby lowering the fluid density. The lowered fluid density decreases the fluid column head and allows the tubing string fluids above the open pressure regulating valve 34 to be more easily produced to the surface 74 (as illustrated by the upward arrows) using the existing formation pressure. The removal of formation liquid to the surface 74 relieves backpressure on the formation 72 which in turn allows more gas to be evolved from the formation 72. The additional formation gas increases the pressure of the trapped gas within the annulus 32, which perpetuates the downward movement of the formation liquid toward the lower end of the tailpipe 30. Thus, the use of pressure regulating valves 34, 36, 38 mounted in the tailpipe section 30 of a tubing string 13 permits otherwise accumulating formation fluids to be produced to the surface 74 using the existing formation pressure.

In essence, FIGS. 4A, 4B, and 4C also represent a first step in a systematic method of removing formation liquid build-up beneath the packer 14 and across the perforated zones 12 of the well bore 8. In a next step, after the formation liquid is removed above the first opened pressure regulating valve 34 by the trapped gas in the annulus 32, the opened pressure regulating valve 34 is closed (i.e. by a compression spring or other known means for returning a valve to its closed position) to prevent all of the trapped annulus gas from being produced to the surface 74 through the opened pressure regulating valve 34. This permits the next lowest pressure regulating valve 36, 38 on the tailpipe section 30 of the tubing string 13 to open and operate in the same capacity as the previous pressure regulating valve 34. As the trapped formation gas in the annulus 32 beneath the packer 14 accumulates and builds in pressure (as illustrated by the downward arrows), the remaining formation liquid in the annulus 32 below the previous pressure regulating valve 34 is forced downward toward and below the next lowest pressure regulating valve 36, 38.

Figure 4D:
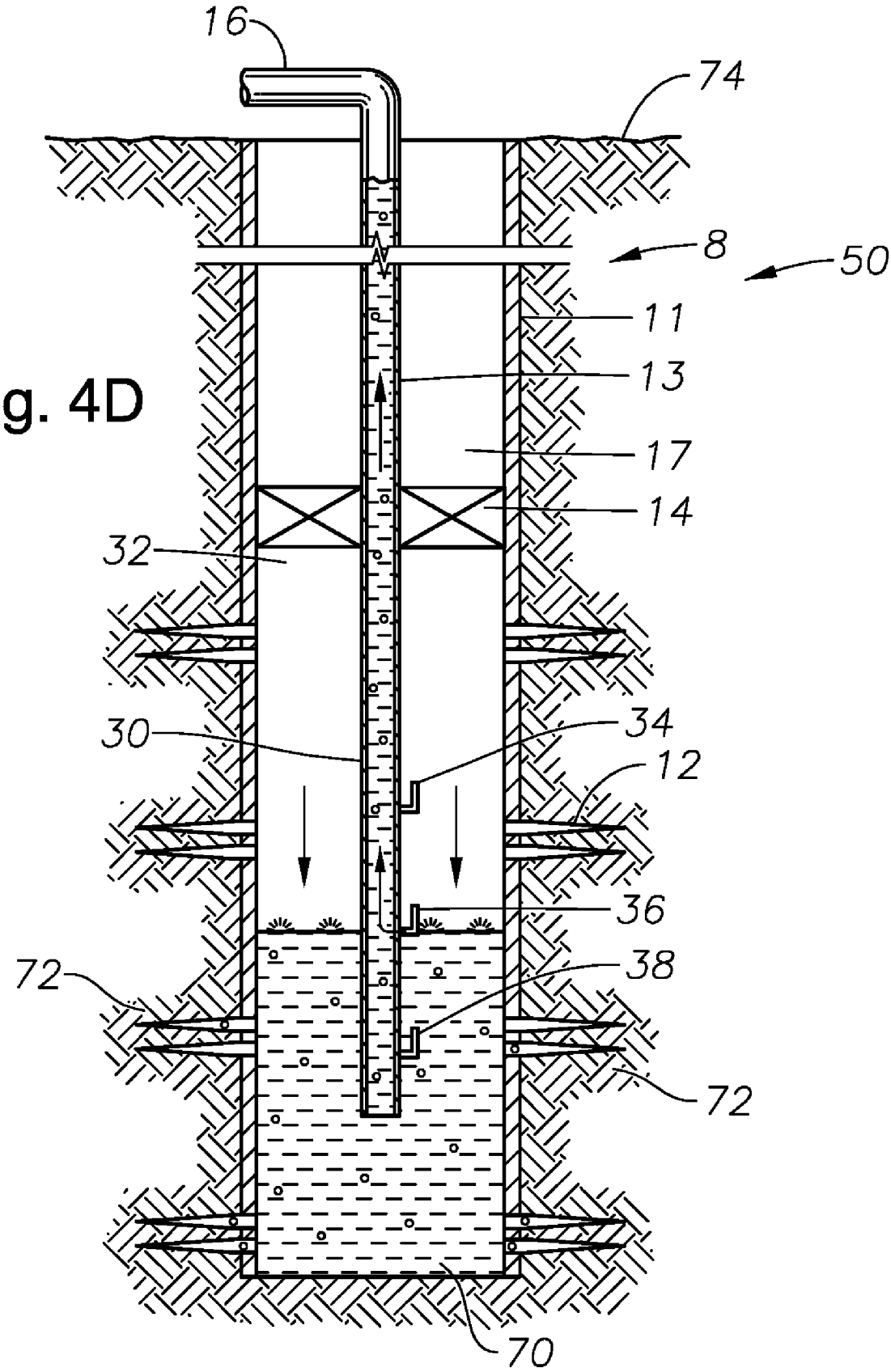

As shown in FIG. 4D, the trapped gas passes into the tailpipe section 30 of the tubing string 13 through the next lowest open pressure regulating valve 36, 38. As trapped annular gas passes into the tubing string 13 through the open pressure regulating valve 36, 38, the gas mixes with the formation liquid above the pressure regulating valve 36, 38 thereby lowering the fluid density. The lowered fluid density decreases the fluid column head and allows the tubing string fluids above the open pressure regulating valve 36, 38 to be more easily produced to the surface 74 (as illustrated by the upward arrows) using the existing formation pressure. The continued removal of the annular column of formation liquid to the surface 74 relieves backpressure on the formation 72 which in turn allows more gas to be evolved from the formation 72. The additional formation gas increases the pressure of the trapped gas within the annulus 32, which perpetuates the downward movement of the formation liquid toward the lower end of the tailpipe 30.

In a next step, the open pressure regulating valve 36, 38 is closed, thereby allowing the next lowest pressure regulating valve 38, if any, to open and operate in the same capacity as the previously open pressure regulating valve 36. This method of systematically unloading the tubing string 13 and the annulus 32 beneath the packer 14 by opening and closing pressure regulating valves 34, 36, 38 in succession continues until the lower end of the tailpipe section 30 becomes the lowest fluid entry point into the tailpipe section 30.

Differential pressure regulating valves 34, 36, 38 are well known to those skilled in the art and thus will only be briefly described herein. Differential pressure regulating valves 34, 36, 38 function according to a sensed pressure differential between the inside of the tubing string 13 and the annulus 32 surrounding the tubing string 13. For example, the pressure regulating valves 34, 36, 38 may be designed to operate by sensing the pressure in the annulus 32 adjacent the pressure regulating valve 34, 36, 38 and to open the valve 34, 36, 38 to admit the trapped annular formation fluid when that pressure becomes higher than the sensed pressure within the tubing string 13. A higher pressure in the annulus 32 surrounding the tubing string 13 is indicative of accumulating formation gases in the annulus 32 beneath the packer 14 which forces the formation liquids downward toward and below a pressure regulating valve 34, 36, 38.

At a certain pressure differential, the pressure regulating valve 34, 36, 38 opens allowing the trapped annular gas to "push" the formation liquids disposed within the tubing string 13 above the pressure regulating valve 34, 36, 38 upwards toward the surface 74 through the tubing string 13. The pressure differential subsides after some trapped annular gas is produced to the surface 74 through the opened pressure regulating valve 34, 36, 38 and the pressure regulating valve 34, 36, 38 subsequently closes. Preferably, a compression spring (not shown) is used to keep the pressure regulating valve 34, 36, 38 in its closed position, however, other means of returning a pressure regulating valve 34, 36, 38 to its closed position, such as gas pressure chambers, are well known in the art and may be equally used. When the differential pressure reaches a certain point, the compression spring (not shown) is compressed by the higher pressure trapped annular gas thereby opening the pressure regulating valve 34, 36, 38 (i.e. opening the fluid communication point between the inside and outside of the tubing string 13). As the differential pressure subsides, the spring (not shown) decompresses and closes the pressure regulating valve 34, 36, 38 (i.e. closing the fluid communication point between the inside and outside of the tubing string 13). During the unloading process, the pressure regulating valves 34, 36, 38 disposed in the tailpipe section 30 above the decreasing formation liquid level remain closed due to the difference in the required casing pressures to open and close the pressure regulating valves 34, 36, 38. Thus, the pressure regulating valves 34, 36, 38 at successively lower levels on the tailpipe section 30 work in tandem with the trapped annular formation gas to systematically remove accumulating formation fluid from the bottom 70 of the well bore 8 using only the existing formation pressure.

If desired, the pressure regulating valves 34, 36, 38 can readily be converted to a wireline retrievable device that can be run and set in the carrier subs/side pocket mandrels (not shown) disposed within the tailpipe section 30 of the tubing string 13. As an alternative to the differential pressure regulating valves 34, 36, 38 previously described, orifices may be disposed within the tailpipe section 30 of the tubing string 13. Preferably, the orifices are arranged and designed within the tailpipe 30 to allow greater flows of formation gas to pass therethrough, between the annulus 32 and the tubing string 13, as the tailpipe section 30 extends downward toward the bottom 70 of the well bore 8.

The Abstract of the disclosure is written solely for providing the United States Patent and Trademark Office and the public at large with a means by which to determine quickly from a cursory inspection the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A well arrangement (50) for recovering formation liquids from a well (8), said arrangement comprising:

a tubing string (13) disposed within a well bore (8), where an annulus (32) is defined between an outer wall of said tubing string (13) and an inner wall (11) of said well bore (8), said tubing string (13) having an upper end portion and a lower end portion (30) with said lower end portion (30) extending to a bottom tip of said tubing string (13), a lowermost packer (14) disposed within said annulus (32) and positioned between said upper end portion and said lower end portion (30) of said tubing string (13) such that no additional packer is positioned between said lowermost packer (14) and said bottom tip of said tubing string (13), and a plurality of flow regulators (34, 36, 38) disposed in said lower end portion (30) of said tubing string (13) between said lowermost packer (14) and said bottom tip of said tubing string (13), said plurality of flow regulators (34, 36, 38) providing fluid communication between said annulus (32) and said tubing string (13) and being arranged and designed to systematically lower any level of formation liquids in said annulus (32) between said lowermost packer (14) and said bottom tip of said tubing string (13) to a level adjacent said bottom tip of said tubing string (13) by controlling flow of formation liquids into said tubing string (13).

2. The arrangement of claim 1 wherein, said inner wall (11) of said well bore (8) is a well casing.

3. The arrangement of claim 1 wherein, said plurality of flow regulators (34, 36, 38) are valves.

4. The arrangement of claim 3 wherein, said valves are pressure regulating valves.

5. The arrangement of claim 1 wherein, said plurality of flow regulators (34, 36, 38) are orifices.

6. In a well arrangement (50) which includes, a tubing string (13) disposed within a well bore (8), where an annulus (32) is defined between an outer wall of said tubing string (13) and an inner wall (11) of said well bore (8), said tubing string (13) having an upper end portion and a lower end portion (30) with said lower end portion (30) extending to a bottom tip of said tubing string (13), a lowermost packer (14) disposed within said annulus (32) and positioned between said upper end portion and said lower end portion (30) of said tubing string (13) such that no additional packer is positioned between said lowermost packer (14) and said bottom tip of said tubing string (13), and a flow regulator (34, 36, 38) disposed in said lower end portion (30) of said tubing string (13), said flow regulator (34, 36, 38) providing fluid communication between said annulus (32) and said tubing string (13) and being arranged and designed to systematically lower any level of formation liquids in said annulus (32) between said lowermost packer (14) and said bottom tip of said tubing string (13) to a level near said bottom tip of said tubing string (13) by controlling flow of formation liquids into said tubing string (13), a method of recovering formation liquids from said well bore (8), said method comprising the steps of, collecting formation gas in said annulus (32) below said lowermost packer (14), and allowing said collected formation gas to force formation liquids through said flow regulator (34, 36, 38) into said tubing string (13) and to cause said formation liquids to be removed upwards through said tubing string (13), thereby lowering any level of formation liquids in said annulus (32) above said flow regulator (34, 36, 38) to a level near said bottom tip of said tubing string (13).

7. The method of claim 6 wherein, said inner wall (11) of said well bore (8) is a well casing.

8. The method of claim 6 wherein, said flow regulator (34, 36, 38) is a valve.

9. The method of claim 8 wherein, said valve is a pressure regulating valve.

10. The method of claim 9 wherein, said step of allowing said collected formation gas to force formation liquids through said flow regulator (34, 36, 38) occurs when a pressure differential between said annulus (32) and said tubing string (13) is greater than a preset value.

11. The method of claim 6 wherein, said flow regulator (34, 36, 38) is an orifice.

12. In a gas well arrangement (50) which includes, a tubing string (13) disposed within a well bore (8), where an annulus (32) is defined between an outer wall of said tubing string (13) and an inner wall (11) of said well bore (8), said tubing string (13) having an upper end portion and a lower end portion (30) with said lower end portion (30) extending to a bottom tip of said tubing string (13), a lowermost packer (14) disposed within said annulus (32) between said upper end portion and said lower end portion (30) of said tubing string (13) such that no additional packer is positioned between said lowermost packer (14) and said bottom tip of said tubing string (13), a first flow regulator (34) disposed in said lower end portion (30) of said tubing string (13), said first flow regulator (34) providing fluid communication between said annulus (32) and said tubing string (13), and a lowermost flow regulator (36, 38) disposed in said lower end portion (30) of said tubing string (13) between said first flow regulator (34) and said bottom tip of said tubing string (13), said lowermost flow regulator (36, 38) providing fluid communication between said annulus (32) and said tubing string (13), a method of recovering formation liquids from said well bore (8), said method comprising the steps of, collecting formation gas in said annulus (32) below said lowermost packer (14), allowing said collected formation gas to force formation liquids through said first flow regulator (34) into said tubing string (13) and to cause said formation liquids to be removed upwards through said tubing string (13), thereby lowering any level of formation liquids in said annulus (32) above said first flow regulator (34) to a level near said first flow regulator (34), collecting additional formation gas in said annulus (32) below said lowermost packer (14), and allowing said collected additional formation gas to force formation liquids through said lowermost flow regulator (36, 38) into said tubing string (13) and to cause said formation liquids to be removed upwards through said tubing string (13), thereby lowering any level of formation liquids in said annulus (32) above said lowermost flow regulator (36, 38) to a level near said bottom tip of said tubing string (13).

13. The method of claim 12 wherein, said inner wall (11) of said well bore (8) is a well easing.

14. The method of claim 12 wherein, said first flow regulator (34) and said lowermost flow regulator (36, 38) are valves.

15. The method of claim 14 wherein, said valves are pressure regulating valves.

16. The method of claim 15 wherein, said steps of allowing said collected formation gas to force formation liquids through said first flow regulator (34) and said lowermost flow regulator (36, 38) occur when a pressure differential between said annulus (32) and said tubing string (13) is greater than a preset value.

17. The method of claim 12 wherein, said first flow regulator (34) and said lowermost flow regulator (36, 38) are orifices.

18. The method of claim 17 wherein, said orifices are arranged and designed to allow greater flows of formation fluids to pass therethrough at increasing depths within the well bore (8).

19. The method of claim 12 wherein, said first flow regulator (34) and said lowermost flow regulator (36, 38) are strategically disposed in said lower end portion (30) of said tubing string (13) to facilitate the systematic removal of formation liquids in said annulus (32) between said lowermost packer (14) and said bottom tip of said tubing string (13).

20. The method of claim 12 further comprising the step of, repeating the steps of;

collecting additional formation gas in said annulus (32) below said lowermost packer (14), and allowing said collected additional formation gas to force formation liquids into said tubing string (13) through a lower disposed additional flow regulator (36) positioned between said first flow regulator (34) and said lowermost flow regulator (38) and to cause said formation liquids to be removed upwards through said tubing string (13), thereby lowering any level of formation liquids in said annulus (32) above said lower disposed additional flow regulator (36) to a level near said lower disposed additional flow regulator (36), until formation liquids in said annulus (32) between said lowermost packer (14) and said lowermost flow regulator (38) approach a level near said lowermost flow regulator (38).

* * * * *